US006512334B2

(12) United States Patent
Kao et al.

(10) Patent No.: US 6,512,334 B2
(45) Date of Patent: Jan. 28, 2003

(54) ORGANIC ELECTROLUMINESCENCE MATRIX-TYPE SINGLE-PIXEL DRIVERS

(75) Inventors: Min-Sheng Kao, Tu-Cheng (TW); Chia-Shy Chang, Hsinchu (TW); Pen-Yu Chen, Taichung Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/805,561

(22) Filed: Mar. 14, 2001

(65) Prior Publication Data

US 2002/0101171 A1 Aug. 1, 2002

(30) Foreign Application Priority Data

Dec. 29, 2000 (TW) ..... 89128285 A

(51) Int. Cl.[7] ..... G09G 3/10

(52) U.S. Cl. ..... 315/169.1; 315/169.3; 345/76; 345/92; 327/108; 327/424

(58) Field of Search ..... 315/169.3, 169.1; 345/74, 76, 55, 82, 92, 205, 206; 327/112, 108, 423, 424, 496

(56) References Cited

U.S. PATENT DOCUMENTS

| | | | | | |
|---|---|---|---|---|---|
| 4,829,359 | A | * | 5/1989 | O et al. | 257/372 |
| 5,699,001 | A | * | 12/1997 | Awaji et al. | 327/108 |
| 5,724,519 | A | * | 3/1998 | Kato et al. | 345/10 |
| 6,037,718 | A | * | 3/2000 | Nagami | 315/169.3 |
| 6,104,040 | A | * | 8/2000 | Kawachi et al. | 257/288 |
| 6,229,506 | B1 | * | 5/2001 | Dawson et al. | 345/82 |

* cited by examiner

*Primary Examiner*—Haissa Philogene
(74) *Attorney, Agent, or Firm*—Rabin & Berdo, P.C.

(57) ABSTRACT

An organic electroluminescence (OEL) matrix-type single-pixel driver, which comprises: an OEL device, a first transistor, and a second transistor. The first transistor and the second transistor form a complementary structure so that when the data line uses the first transistor to drive an organic light-emitting diode (OLED) device, the second transistor is in the OFF state, causing no power consumption. When the data line is in the LOW state, the first transistor is in the OFF state. The second transistor is in a sub-threshold state after getting rid of extra charges.

12 Claims, 6 Drawing Sheets

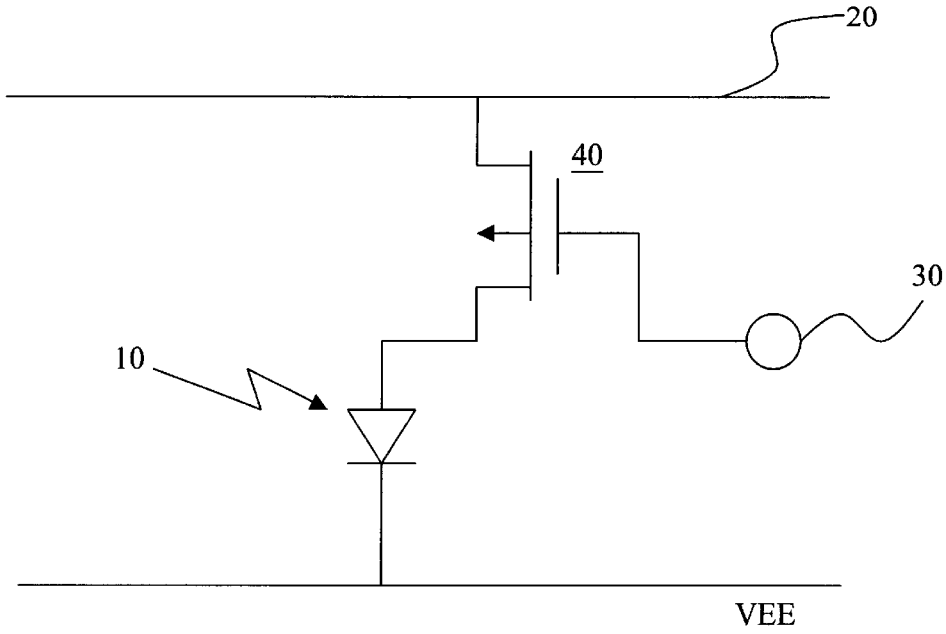
PRIOR ART Fig.1
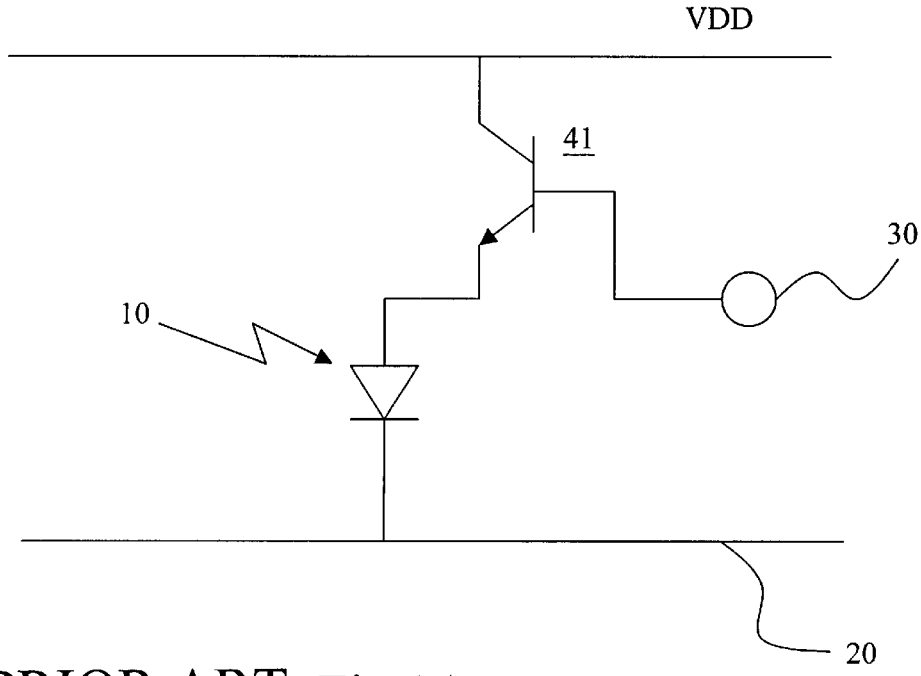
PRIOR ART Fig.1A

ORGANIC ELECTROLUMINESCENCE MATRIX-TYPE SINGLE-PIXEL DRIVERS

BACKGROUND OF THE INVENTION

1. Field of Invention

The present invention relates to a single-pixel driver and, in particular, to an organic electroluminescence matrix-type single-pixel driver.

2. Related Art

The organic electroluminescence (OEL) structure usually consists of a glass substrate, a transparent indium-tin-oxide (ITO) anode, HTL&EML, and a metal cathode. When a voltage is imposed on such an OEL display, electrons and holes flow into the HTL&EML through the anode and the cathode, respectively. The annihilation of electrons and holes produces excitons and radiate photons. The OEL displays can be roughly classified into two different systems according to the material. The molecule-based device using dye or color materials is called an organic light-emitting diode (OLED), and the polymer-based device using conjugate polymers is called a polymer light-emitting diode (PLED). OEL displays have many advantages such as self-luminescence, back-light source free, high illumination efficiencies, low operation voltages, quick responses, no view angle limitations, wide operation temperature ranges, low power consumption, low manufacturing costs, being able to produce true colors, and extremely small thickness. They satisfy all the requirements for multimedia and will be the most favorable devices for modern displays.

Recently, due to the need in high resolutions in display panels, the pixel rate also increases. OLED devices 10, however, are limited by its material characters and parasite capacitance and thus cannot readily turn off pixels when the operation frequency increases accordingly (around 50 KHz). As shown in FIG. 1, VEE can connect to a low potential or negative pulse. A scan line 20 provides scan signals and a data line 30 controls the switch of transistors 40 so as to make the OLED device 10 emit light. The brightness can be further changed by adjusting the pulse width and amplitude imposed on the data line 30. Its drawback is that when the operation frequencies of both the scan line 20 and the data line 30 increase, the charge/discharge time is greater than the width of the pulse because of the OLED parasite capacitance effect. Thus, some pixels cannot become dark readily; that is, the OLED devices cannot easily turn off the pixels. For a conventional circuit as shown in FIG. 1A, where the transistor 40 is replaced by an NPN transistor 41, the OLED device still cannot readily turn off the pixel.

Accordingly, designing an OLED driver that can increase the operation frequency of the OLED and at the same time satisfy the requirements for high resolutions has become an important subject.

SUMMARY OF THE INVENTION

It is a primary objective of the present invention to provide a single-pixel driver, whose driving method is to use a transistor to control and accelerate the charge/discharge work speed of OLED devices so as to reach the needed work frequency (1 MHz).

The present invention adds a bypass transistor for discharging in a conventional driver so as to solve the response delay due to the parasite capacitance effect and to speed up charge removal. The circuit includes at least: an organic electroluminescence (OEL) device, a first transistor, and a second transistor. The first transistor and the second transistor form a complementary structure so that when the data line uses the first transistor to drive the OLED device, the second transistor is in the OFF state, causing no power consumption. When the data line is in the LOW state, the first transistor is in the OFF state. The second transistor is in a sub-critical state after getting rid of extra charges. Therefore, the only power loss in the whole circuit is due to the leakage current of the first transistor. The power loss is in the order of pico-watts.

The first transistor and the second transistor proposed herein can be replaced by an NPN transistor, a PNP transistor, an NMOS or a PMOS.

The driver disclosed herein can be accompanied by a resistor so as to linearly control the voltage. The resistor can be replaced by an active transistor load.

BRIEF DESCRIPTION OF THE DRAWINGS

The present invention will become more fully understood from the detailed description given hereinbelow illustration only, and thus are not limitative of the present invention, and wherein:

FIGS. 1 and 1A are circuits of conventional organic EL matrix-type single-pixel drivers;

In the various drawings, the same references relate to the same elements.

DETAILED DESCRIPTION OF THE INVENTION

An organic light-emitting diode (OLED) display is a matrix of OLED devices, each of which forms a pixel, and each column in the matrix has a scan line and each row has a data line. The light-emitting behavior of the OLED devices is controlled by manipulating the potentials on the scan line and the data line.

Figure 2:
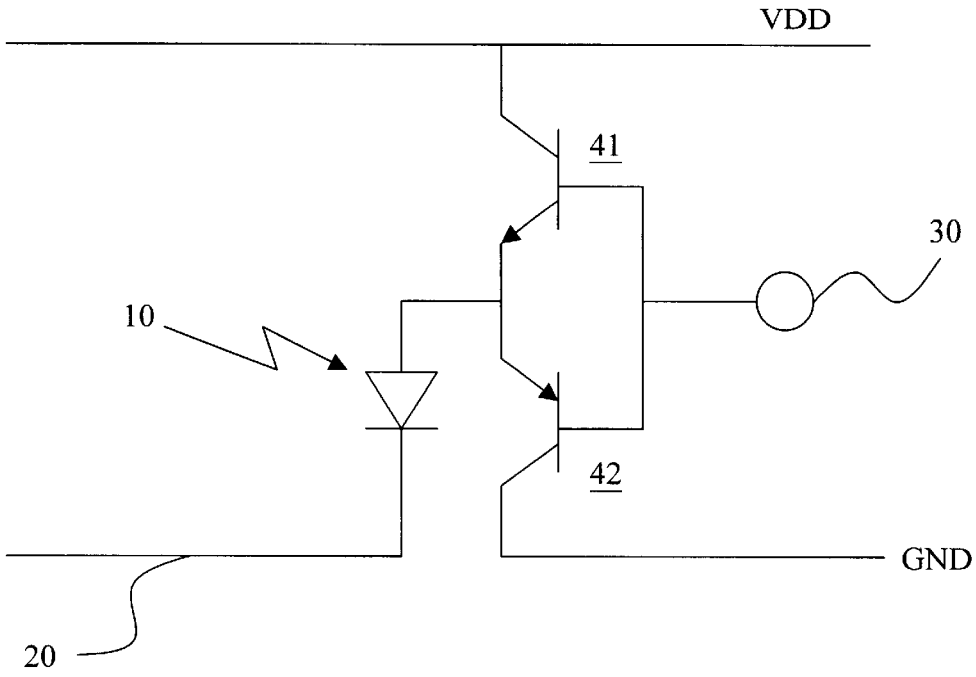
FIGS. 2, 2A, 2B, and 2C are circuits of the organic EL matrix-type single-pixel drivers according to the first embodiment of the invention.

To solve the problem of the inability to readily turn off pixels in conventional organic electroluminescence (OEL) matrix-type single-pixel drivers, the present invention controls the OLED devices by controlling the scan line and utilizing VDD. The invention further proposes to add a bypass transistor for discharging to a conventional driver so as to eliminate the response delay effect due to parasite capacitance and to speed up charge removal. With reference to FIG. 2, VDD is a voltage source and the scan line 20 is used to selectively scan. When the scan line 20 is at LOW, it is enabled; while when the scan line 20 is at HIGH, it is disenabled. The data line 30 controls the switch of an NPN transistor 41 so as to make the OLED device 10 emit light. To increase the switch frequency of the OLED device 10, a PNP transistor 42 is employed to solve the response delay effect caused by the parasite capacitance and to speed up charge removal. The brightness is adjusted by further varying the voltage amplitude imposed on the data line 30. When the data line 30 is at LOW, the NPN transistor 41 is in the OFF state. The PNP transistor 42 enters the sub-critical state after discharging extra charges. Therefore, the only power consumption is caused by the leakage current of the NPN transistor 41 and is on the order of pico-watts.

The collector of the NPN transistor 41 couples to the voltage source VDD. The emitter of the NPN transistor 41 and the emitter of the PNP transistor 42 couple together to the anode of the OLED device 10. The base of the NPN transistor 41 and the base of the PNP transistor 42 couple together to the data line 30. The cathode of the OLED device 10 couples to the scan line 20. The collector of the PNP transistor 42 couples to the ground (GND).

Figure 2A:
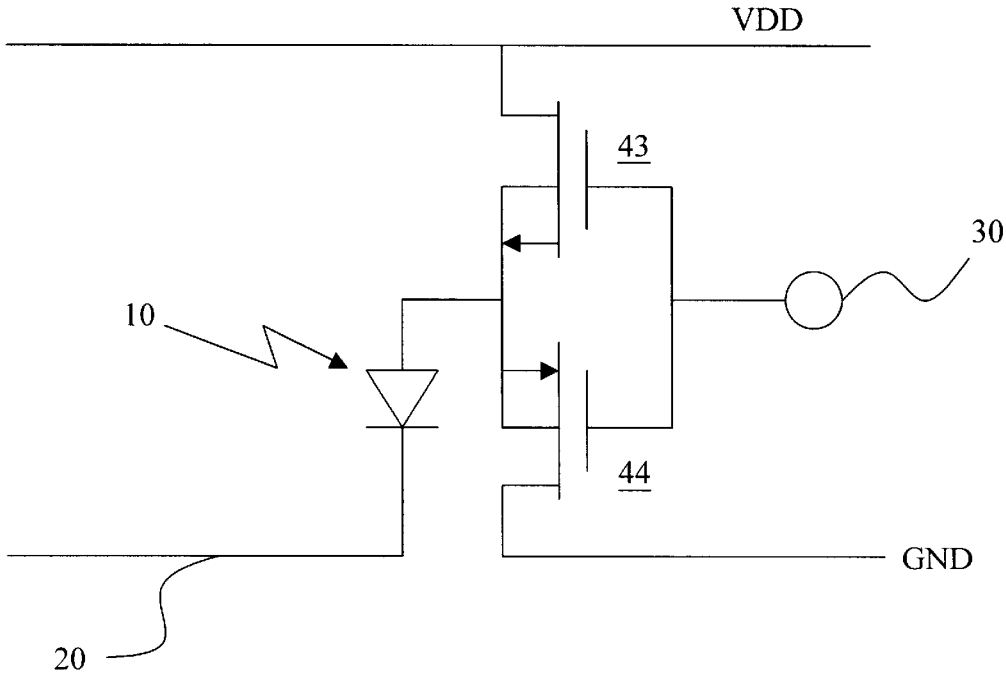
Figure 2B:
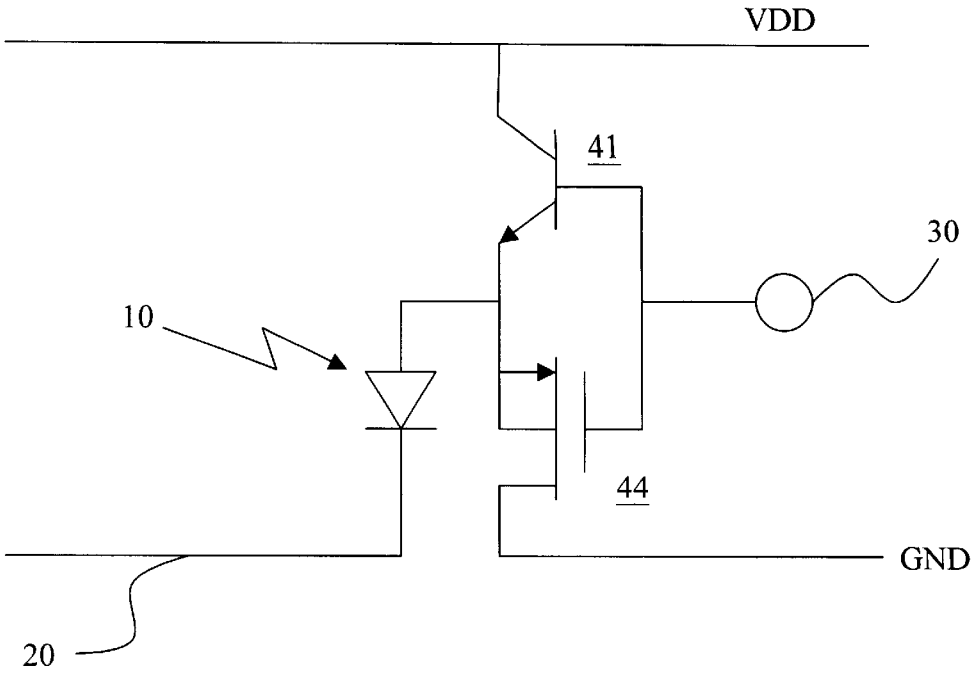
Figure 2C:
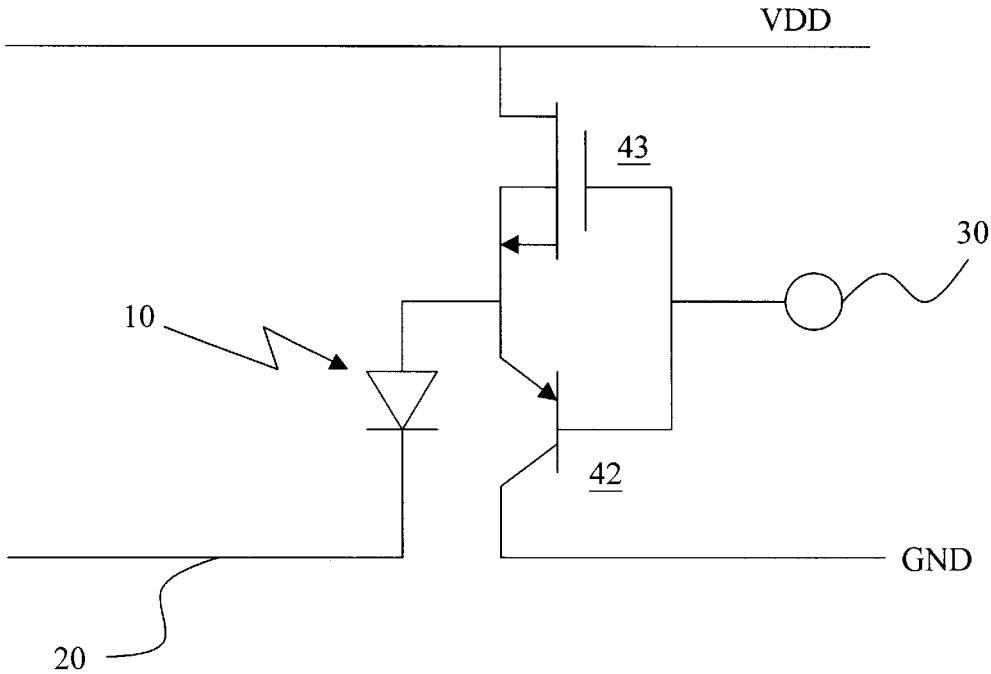

FIGS. 2A, 2B and 2C show variations of the OEL matrix-type single-pixel driver according to the first embodiment.

FIG. 2A illustrates that the NPN transistor 41 can be replaced by an NMOS 43 and the PNP transistor 42 can be replaced by a PMOS 44. FIG. 2B says that the PNP transistor 42 can be replaced by a PMOS 44. FIG. 2C shows that the NPN transistor 41 is replaced by an NMOS 43. These variations, however, still share the same functions and characters of that in FIG. 2.

In FIG. 2A, the drain of the NMOS 43 couples to VDD. The source and the base of the NMOS 43 and the source and the base of the PMOS 44 couple together to the anode of the OLED device 10. The gate of the NMOS 43 and the gate of the PMOS 44 couple together to the data line 30. The cathode of the OLED device 10 couples to the scan line 20. The drain of the PMOS 44 couples to GND.

In FIG. 2B, the collector of the NPN transistor 41 couples to VDD. The emitter of the NPN transistor 41 and the source and the base of the PMOS 44 couple together to the anode of the OLED device 10. The base of the NPN transistor 41 and the gate of the PMOS 44 couple together to the data line 30. The cathode of the OLED device 10 couples to the scan line 20. The drain of the PMOS 44 couples to GND.

In FIG. 2C, the drain of the NMOS 41 couples to VDD. The source and the base of the NMOS 43 and the emitter of the PNP transistor 42 couple together to the anode of the OLED device 10. The gate of the NMOS 43 and the base of the PNP transistor 42 couple together to the data line 30. The cathode of the OLED device 10 couples to the scan line 20. The collector of the PNP transistor 42 couples to GND.

Figure 3:
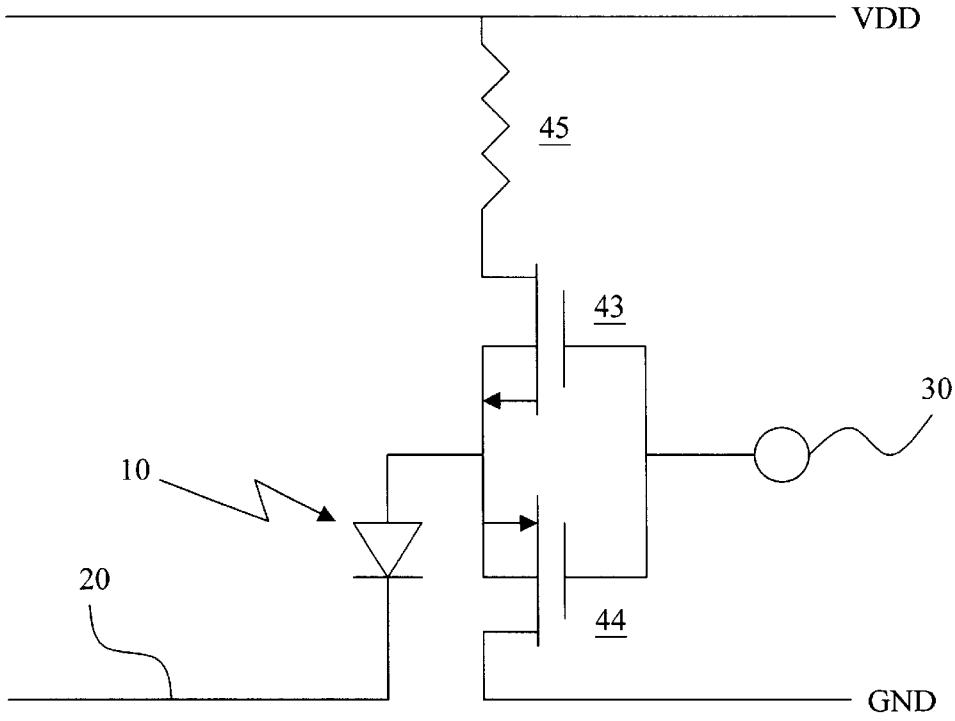
FIGS. 3 and 3A are circuits of the organic EL matrix-type single-pixel drivers according to the second embodiment of the invention.

With reference to FIG. 3, VDD is a tunable voltage source. The scan line 20 is used to selectively scan. When the scan line 20 is at LOW, it is enabled; when the scan line 20 is at HIGH, it is disenabled. The data line 30 controls the switch of an NMOS 43 and adjusts the voltage, thus controlling the brightness of the OLED device 10. Assisted by a resistor 45, a linear control on the voltage can be achieved. To increase the switch frequency of the OLED device 10, a PMOS 44 is similarly employed to solve the response delay effect caused by parasite capacitance and to speed up charge removal. The drain of the NMOS 43 couples to VDD through the resistor 45. The source and the base of the NMOS 43 and the source and the base of the PMOS 44 couple together to the anode of the OLED device 10. The gate of the NMOS 43 and the gate of the PMOS 44 couple together to the data line 30. The cathode of the OLED device 10 couples to the scan line 20. The drain of the PMOS 44 couples to GND.

Figure 3A:
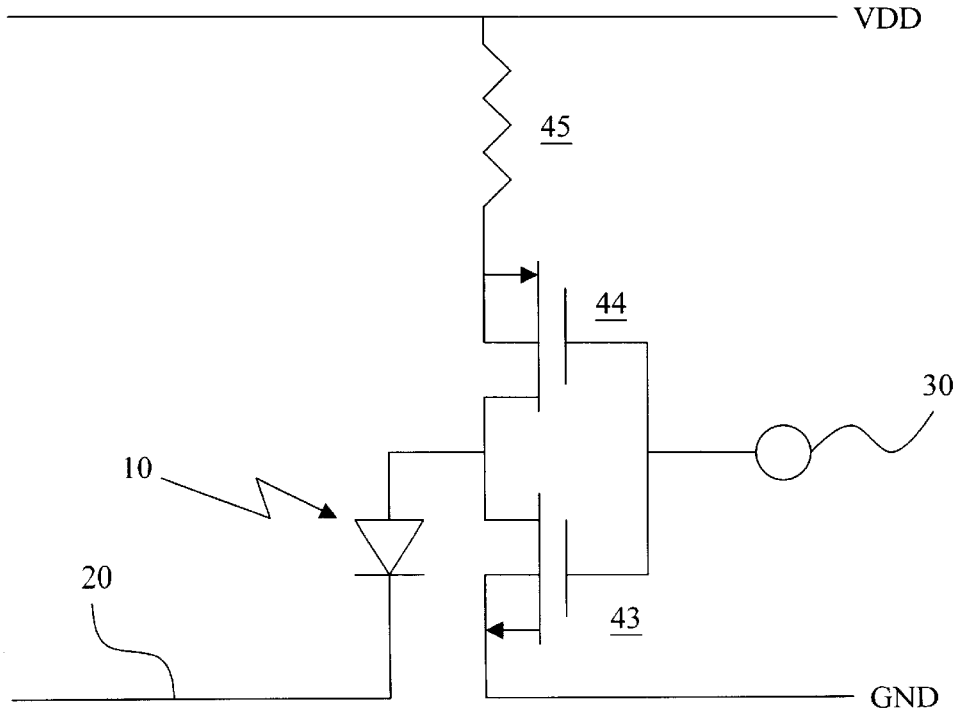

With reference to FIG. 3A, the NMOS 43 and the PMOS 44 in the second embodiment of the invention are replaced by a PMOS 44 and an NMOS 43, respectively. The source and the base of the PMOS 44 couple together to VDD through the resistor 45. The drain of the PMOS 44 and the drain of the NMOS 43 couple together to the anode of the OLED device 10. The gate of the PMOS 44 and the gate of the NMOS 43 couple together to the data line 30. The cathode of the OLED device 10 couples to the scan line 20. The source and the base of the NMOS 43 couple together to GND.

Figure 4:
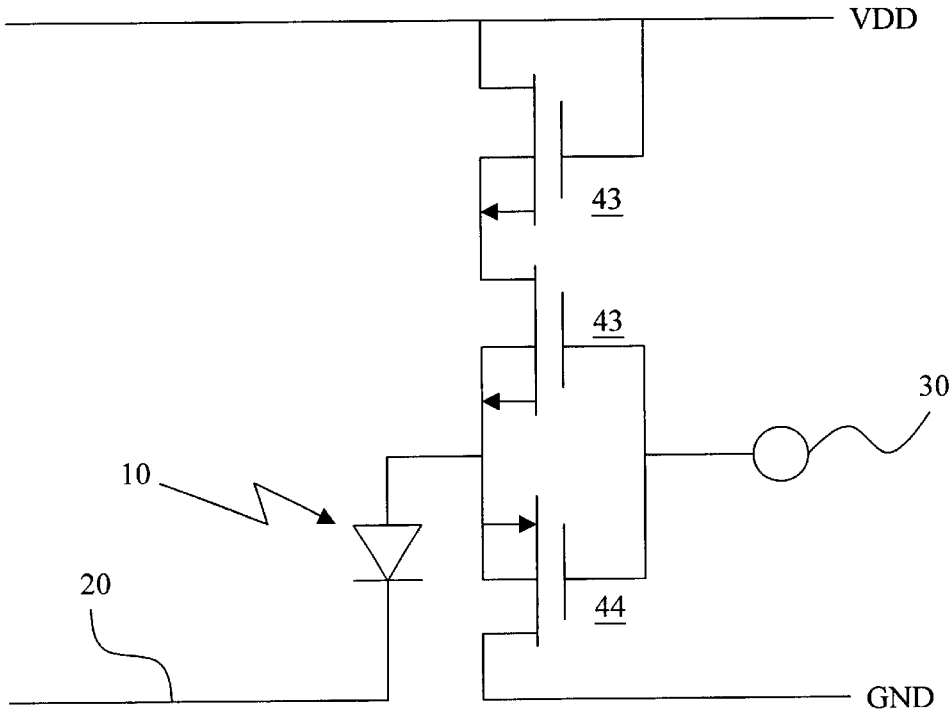
FIGS. 4 and 4A are circuits of the organic EL matrix-type single-pixel drivers according to the third embodiment of the invention.
Figure 4A:
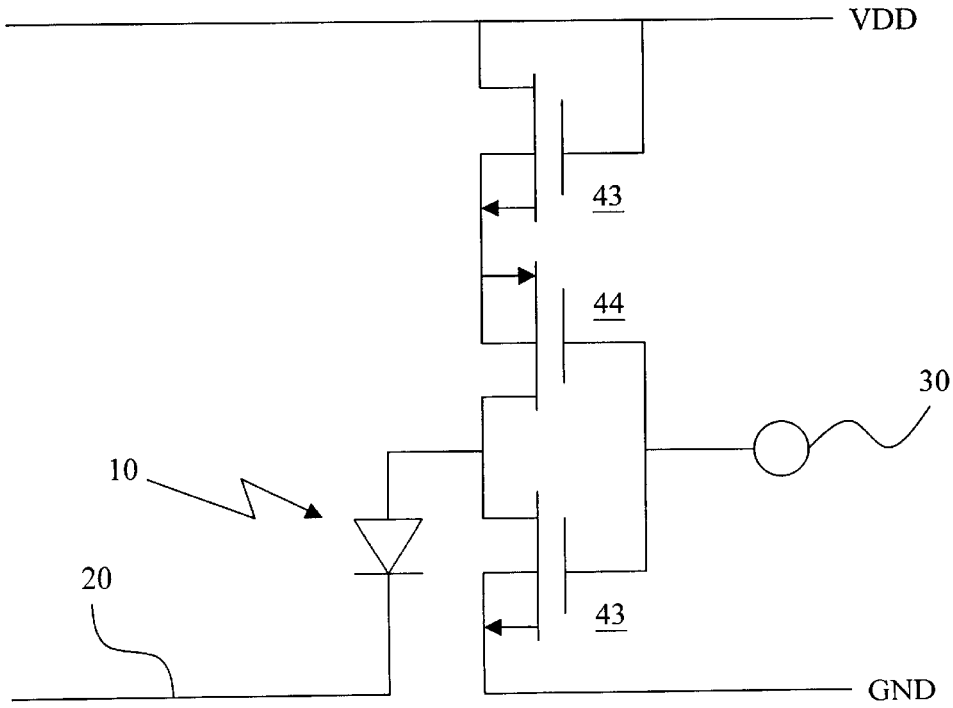

With reference to FIG. 4 for a third embodiment of the invention, the resistor 45 in FIG. 3 is replaced by an active NMOS 43 load. The new driver still has the same functions and characters as that in FIG. 3. FIG. 4A is a variation circuit of the OEL matrix-type single-pixel driver according to the third embodiment of the invention. The resistor 45 in FIG. 3A is replaced by an active NMOS 43. The new driver still has the same functions and characters as that in FIG. 3A.

Figure 5:
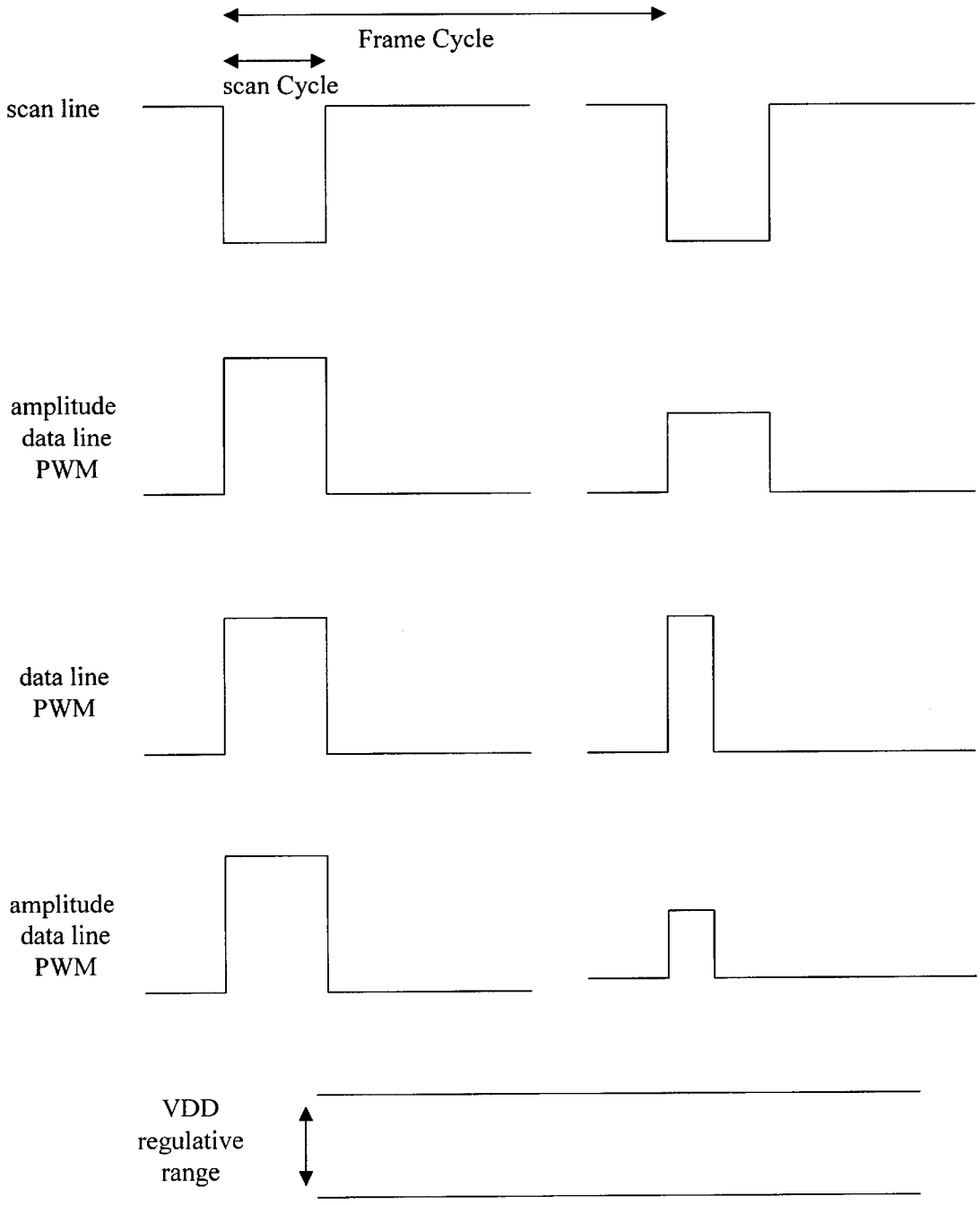
FIG. 5 is a schematic view of the driving voltages of the scan line and the data line in the disclosed organic EL matrix-type single-pixel driver.

FIG. 5 is a schematic view of the driving voltages of the scan line and the data line in the disclosed organic EL matrix-type single-pixel driver.

ADVANTAGES OF THE INVENTION

The present invention proposes to add a bypass transistor for discharging in a conventional driver to solve the response delay effect caused by parasite capacitance and to speed up charge removal. It has the advantages of:

1. high resolutions under high speed;
2. energy saving in practical applications;
3. achieving gray scale effects by adjusting the work voltage; and
4. having a longer lifetime.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An organic electroluminescence (OEL) matrix-type single-pixel driver, which comprises:

an OEL device with an anode and a cathode;

an NPN transistor with a collector, an emitter, and a base; and a PNP transistor with a collector, an emitter, and a base;

wherein the collector of the NPN transistor couples to a voltage source, the emitter of the NPN transistor and the emitter of the PNP transistor couple together to the anode of the OEL device, the base of the NPN transistor and the base of the PNP transistor couple together to a data line, the cathode of the OEL device couples to a scan line, and the collector of the PNP transistor couples to a ground.

2. The driver of claim 1, wherein the OEL device forms a single pixel.

3. The driver of claim 1, wherein the data line controls switching of the NPN transistor to make the OEL device emit light.

4. An organic electroluminescence (OEL) matrix-type single-pixel driver, which comprises:

an OEL device with an anode and a cathode;

an NMOS with a drain, a source, a base, and a gate; and a PMOS with a drain, a source, a base, and a gate;

wherein the drain of the NMOS couples to a voltage source, the source and the base of the NMOS and the source and the base of the PMOS couple together to the anode of the OEL device, the gate of the NMOS and the gate of the PMOS couple together to a data line, the cathode of the OEL device couples to a scan line, and the drain of the PMOS couples to a ground.

5. An organic electroluminescence (OEL) matrix-type single-pixel driver, which comprises:

an OEL device with an anode and a cathode;

an NPN transistor with a collector, an emitter, and a base; and a PMOS with a drain, a source, a base, and a gate;

wherein the collector of the NPN transistor couples to a voltage source, the emitter of the NPN transistor and the source and the base of the PMOS couple together to the anode of the OEL device, the base of the NPN transistor and the gate of the PMOS couple together to a data line, the cathode of the OEL device couples to a scan line, and the drain of the PMOS couples to a ground.

6. An organic electroluminescence (OEL) matrix-type single-pixel driver, which comprises:

an OEL device with an anode and a cathode;

an NMOS with a drain, a source, a base, and a gate; and a PNP transistor with a collector, an emitter, and a base;

wherein the drain of the NMOS couples to a voltage source, the source and the base of the NMOS and the emitter of the PNP transistor couple together to the anode of the OEL device, the gate of the NMOS and the base of the PNP transistor couple together to a data line, the cathode of the OEL device couples to a scan line, and the collector of the PNP transistor couples to a ground.

7. An organic electroluminescence (OEL) matrix-type single-pixel driver, which comprises:

a resistor;

an OEL device with an anode and a cathode;

an NMOS with a drain, a source, a base and a gate; and a PMOS with a drain, a source, a base and a gate;

wherein the drain of the NMOS couples through the resistor to a voltage source, the source and the base of the NMOS and the source and the base of the PMOS couple together to the anode of the OEL device, the gate of the NMOS and the gate of the PMOS couple together to a data line, the cathode of the OEL device couples to a scan line, and the drain of the PMOS couples to a ground.

8. The driver of claim 7, wherein each of the OEL device forms a single pixel.

9. The driver of claim 7, wherein the data line controls the switch of the NPN transistor to make the OEL device emit light.

10. An organic electroluminescence (OEL) matrix-type single-pixel driver, which comprises:

a resistor;

an OEL device with an anode and a cathode;

a PMOS with a drain, a source, a base, and a gate; and an NMOS with a drain, a source, a base, and a gate;

wherein the source and the base of the PMOS couple through the resistor to a voltage source, the drain of the PMOS and the drain of the NMOS couple together to the anode of the OEL device, the gate of the PMOS and the gate of the NMOS couple together to a data line, the cathode of the OEL device couples to a scan line, and the source of the NMOS couples to a ground.

11. An organic electroluminescence (OEL) matrix-type single-pixel driver, which comprises:

an active NMOS load with a drain, a source, a base and a gate;

an OEL device with an anode and a cathode;

an NMOS with a drain, a source, a base and a gate; and a PMOS with a drain, a source, a base and a gate;

wherein the drain of the NMOS couples to the source and the base of the active NMOS load, the drain and the gate of the NMOS load couple to a voltage source, the source and the base of the NMOS and the source and the base of the PMOS couple together to the anode of the OEL device, the gate of the NMOS and the gate of the PMOS couple together to a data line, the cathode of the OEL device couples to a scan line, and the drain of the PMOS couples to a ground.

12. An organic electroluminescence (OEL) matrix-type single-pixel driver, which comprises:

an active NMOS load with a drain, a source, a base and a gate;

an OEL device with an anode and a cathode;

a PMOS with a drain, a source, a base, and a gate; and an NMOS with a drain, a source, a base, and a gate;

wherein the source and the base of the PMOS couple to the source and the base of the active NMOS load, the drain and the gate of the active NMOS load couple to a voltage source, the drain of the PMOS and the drain of the NMOS couple together to the anode of the OEL device, the gate of the PMOS and the gate of the NMOS couple together to a data line, the cathode of the OEL device couples to a scan line, and the source and the base of the NMOS couple together to a ground.

* * * * *